US008136455B2

(12) United States Patent
Rodet et al.

(10) Patent No.: US 8,136,455 B2
(45) Date of Patent: Mar. 20, 2012

(54) PRIMARY SUSPENSION DEVICE FOR A RAILWAY VEHICLE BOGIE

(75) Inventors: Alain Rodet, Chalon sur Saone (FR); Christope Eche, Montchanin (FR)

(73) Assignee: Alstom Transport SA, Levallois-Perret (FR)

( * ) Notice: Subject to any disclaimer, the term of this patent is extended or adjusted under 35 U.S.C. 154(b) by 138 days.

(21) Appl. No.: 12/594,797

(22) PCT Filed: Mar. 14, 2008

(86) PCT No.: PCT/FR2008/050436

§ 371 (c)(1), (2), (4) Date: Oct. 5, 2009

(87) PCT Pub. No.: WO2008/129206

PCT Pub. Date: Oct. 30, 2008

(65) Prior Publication Data

US 2010/0107923 A1 May 6, 2010

(30) Foreign Application Priority Data

Apr. 5, 2007 (FR) ..... 07 54314

(51) Int. Cl.
*B61F 3/00* (2006.01)

(52) U.S. Cl. ..... 105/197.05; 105/199.5; 105/167

(58) Field of Classification Search ..... 105/197.05, 105/218.1, 218.2, 223, 219, 224.1
See application file for complete search history.

(56) References Cited

U.S. PATENT DOCUMENTS

| | | | | |
|---|---|---|---|---|
| 2,621,919 | A * | 12/1952 | Utz | 267/222 |
| 2,676,031 | A * | 4/1954 | Kolbe | 280/124.103 |
| 2,822,185 | A * | 2/1958 | Mineck | 280/124.141 |
| 2,862,742 | A * | 12/1958 | Long, Jr. et al. | 188/205 R |
| 3,080,177 | A * | 3/1963 | Mather | 280/124.136 |
| 3,539,170 | A * | 11/1970 | Hamel | 267/294 |
| 3,620,548 | A * | 11/1971 | Van Winsen et al. | 280/124.138 |
| 3,945,325 | A * | 3/1976 | Zehnder | 105/167 |
| 3,946,676 | A * | 3/1976 | Mackaness et al. | 105/169 |
| 3,948,188 | A * | 4/1976 | Zehnder | 105/167 |
| 5,415,107 | A * | 5/1995 | Tutzauer | 105/218.2 |
| 5,479,863 | A * | 1/1996 | Ahlborn et al. | 105/199.5 |
| 7,185,902 | B1 * | 3/2007 | Lloyd | 280/124.106 |
| 7,234,723 | B2 * | 6/2007 | Sellers | 280/686 |
| 2010/0107923 | A1 * | 5/2010 | Rodet et al. | 105/197.05 |
| 2010/0132586 | A1 * | 6/2010 | Rodet et al. | 105/133 |

FOREIGN PATENT DOCUMENTS

| | | |
|---|---|---|
| CH | 192 957 | 9/1937 |
| DE | 11 76 689 | 8/1964 |
| EP | 0 326 179 | 8/1989 |
| FR | 978 926 | 4/1951 |
| FR | 1 536 401 | 8/1968 |

* cited by examiner

*Primary Examiner* — S. Joseph Morano
*Assistant Examiner* — Jason C Smith
(74) *Attorney, Agent, or Firm* — Davidson, Davidson & Kappel, LLC

(57) ABSTRACT

Disclosed is a device (20) for suspending a first element (16) on a second element (14, 16, 18) of a railway vehicle. Said suspension device (20) comprises two longitudinal rods (26, 28) which are each connected to the first element (16) by means of a first connection point (30, 32) and to the second element (14, 16, 18) by means of a second connection point (34, 36), and at least one elastic member (38) that is positioned between the two rods (26, 28) to define at least the vertical rigidity of the suspension device (20). The two rods (26, 28) are longitudinally offset relative to one another.

13 Claims, 2 Drawing Sheets

PRIMARY SUSPENSION DEVICE FOR A RAILWAY VEHICLE BOGIE

The invention generally relates to suspension devices for a rail vehicle.

More precisely, according to a first aspect, the invention relates to a device for suspending a first element on a second element of a rail vehicle, of the type comprising:

two longitudinal connection rods, each connected via a first connection location to the first element, and via a second connection location to the second element, a resilient member which is interposed between the two connection rods in order to define at least the vertical stiffness of the suspension device.

BACKGROUND

Such a device is known from CH-192 957, in which the resilient member is formed by two tall helical springs which are arranged in parallel in a casing which is formed by two telescopic portions. Each of the two portions of the casing is fixed to one of the connection rods.

Such a suspension device is able to support a heavy load, but has a great height. It cannot be accommodated below a carriage with a low floor, in particular below a tramway carriage having a lowered travel corridor.

SUMMARY OF THE INVENTION

An object of the present invention provides a primary suspension device having a reduced vertical spatial requirement.

The present invention provides a primary suspension device characterised in that the two connection rods are longitudinally offset relative to each other.

The suspension device may also have one or more of the features below, taken individually or according to any technically possible combination:

the two connection rods are substantially parallel with each other and have, between their first and second respective connection locations, substantially the same length longitudinally;

the or each resilient member is a sandwich comprising a plurality of layers of a resilient material and a plurality of metal plates which are interposed between the layers of resilient material and which are adhesively-bonded to the resilient layers;

the two connection rods are positioned in the same vertical plane;

the or each resilient member has a compression axis which forms an angle $\beta$ between 0° and 90° with respect to an axis which extends through the first connection locations of the two connection rods;

the first element is a chassis of a bogie of the rail vehicle and the second element is an axle or an axle box of the bogie;

each of the two connection rods is connected to the axle or the axle box of the bogie at the second connection location thereof by means of a cylindrical resilient articulation and to the chassis of the bogie at the first connection location thereof also by means of a cylindrical resilient articulation;

the connection rods extend perpendicularly relative to the axle and the cylindrical resilient articulations have axes parallel with the axle;

the second connection locations of the two connection rods are longitudinally offset in a symmetrical manner at one side and the other of the axle;

the two connection rods are arranged at a vertical level lower than the apex of the axle or the axle box; and the first element is a rail vehicle body and the second element is a chassis of a bogie of the rail vehicle which is positioned below the body.

According to a second aspect, the present invention provides a rail vehicle bogie comprising at least one suspension device which has the above features.

According to a third aspect, the present invention provides a rail vehicle comprising at least one suspension device which has the above features.

BRIEF DESCRIPTION OF THE DRAWINGS

Other features and advantages of the invention will be appreciated from the detailed description which is given below, by way of non-limiting example, with reference to the appended Figures, in which.

DETAILED DESCRIPTION

Figure 1:
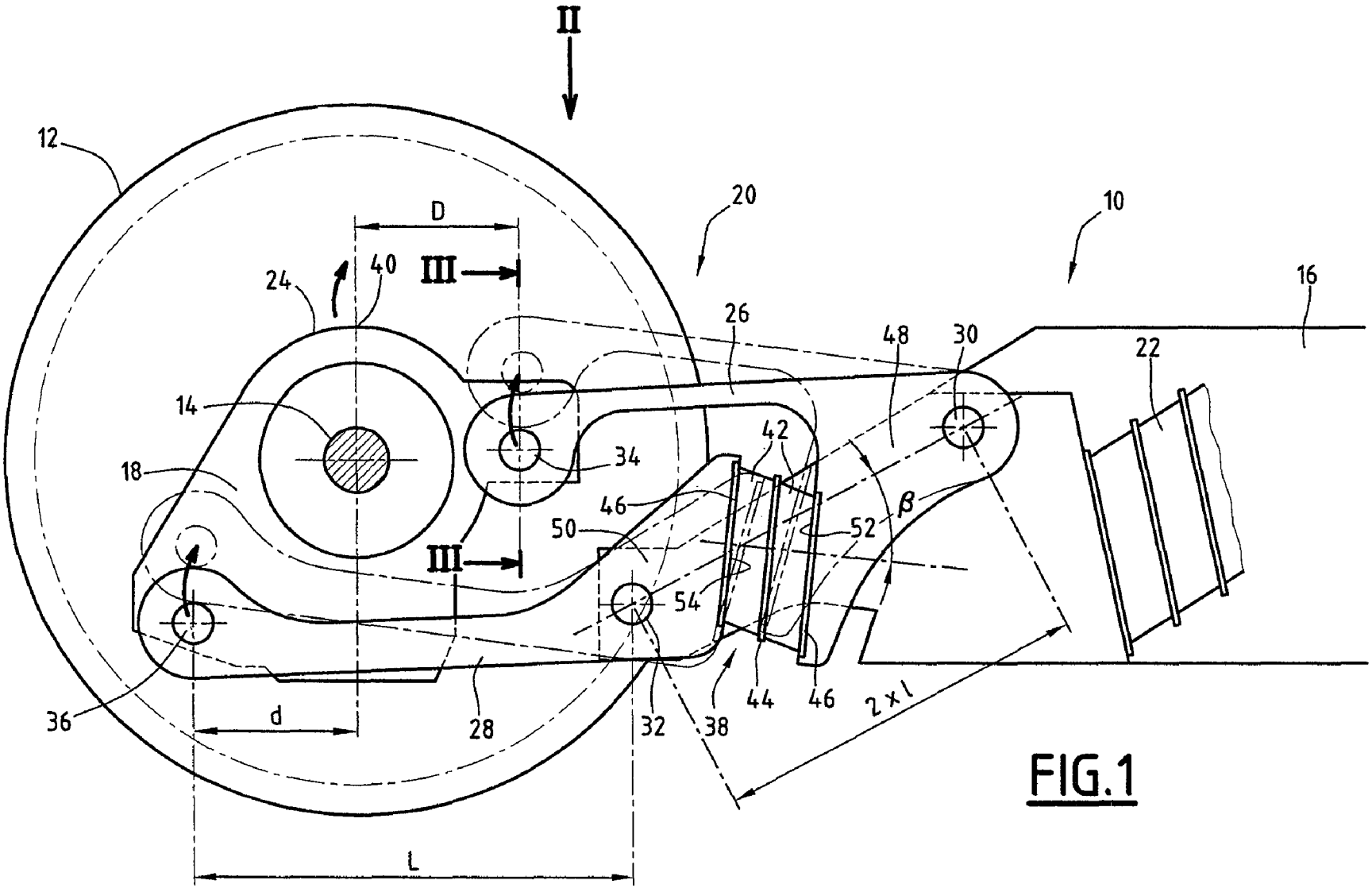
FIG. 1 is a partially sectioned side view of a portion of a bogie comprising a primary suspension according to the invention, the connection rods being illustrated with solid lines in the idle state and being illustrated with broken lines when the wheel associated with the primary suspension is subject to an upward vertical force.

The bogie 10 illustrated partially in FIG. 1 comprises two front wheels 12, and two rear wheels, front axles 14 and rear axles (not shown) which rotatably connect the front wheels 12 and rear wheels to each other, respectively, a chassis 16, for each front and rear wheel, an axle box 18 which forms a bearing for rotatably guiding the corresponding axle, for each front and rear wheel, a primary device 20 for suspending the chassis 16 on the corresponding axle box 18, and a secondary device 22 which is capable of suspending the body of a rail vehicle on the chassis 16.

The chassis 16 is typically formed by longitudinal members and cross-members which are rigidly fixed to each other, the cross-members extending parallel with the axles and the longitudinal members perpendicularly relative to the axles.

The axle boxes 18 of the two wheels associated with the same axle are arranged between the two wheels. The axle box 18 associated with a wheel is arranged in the immediate proximity of this wheel, towards the inner side of the bogie relative to the wheel. The axle box 18 comprises an outer casing 24 through which the axle 14 extends and a bearing, in particular a roller bearing, which is interposed between the axle and the casing 24.

Figure 2:
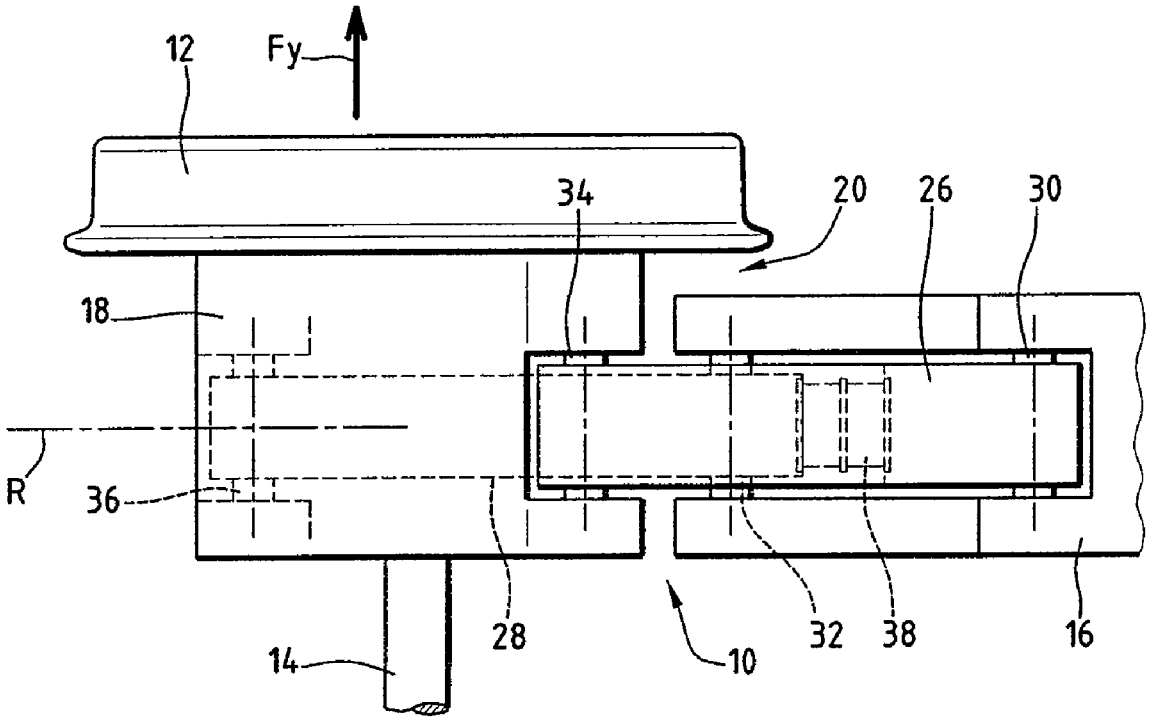
FIG. 2 is a plan view corresponding to FIG. 1.

Each axle box 18 is arranged substantially in continuation of a longitudinal member of the chassis 16, as illustrated in FIG. 2.

Each secondary suspension device 22 is interposed between the body of the rail vehicle supported by the bogie and the chassis 16 of the bogie. It is capable of suspending the body on the chassis 16.

Each primary suspension device 20 comprises two connection rods 26 and 28 which are connected by respective first connection locations 30 and 32 to the chassis 16, and by respective second connection locations 34 and 36 to the casing 24 of the axle box and a resilient member 38 which is interposed between the two connection rods 26 and 28 in order to define at least the vertical stiffness of the primary suspension device 20.

The two connection rods 26 and 28 are positioned in the same vertical plane, that is to say, in the same plane perpendicular relative to the travel plane of the bogie, the connection rod 26, located above the connection rod 28, being referred to in the following description as the upper connection rod, and the connection rod 28 as the lower connection rod.

In the idle state, the two connection rods 26 and 28 are substantially parallel with each other and extend in a longitudinal direction which corresponds substantially to the direction of the longitudinal members of the chassis 16. They are thus perpendicular relative to the axle 14. The connection rods 26 and 28 have, between their first and second respective connection locations, substantially the same longitudinal length.

As illustrated in FIG. 1, the two connection rods 26 and 28 are longitudinally offset relative to each other when the primary suspension device 20 is in the idle state and also when it is under load. In this manner, the upper connection rod 26 is offset towards the right-hand side of FIG. 1, that is to say, towards the chassis 16 relative to the lower connection rod 28. In order to distribute the load on the two connection rods 26 and 28, the second connection locations 34 and 36 of the upper and lower connection rods 26 and 28 are longitudinally offset at one side and the other of the axis of the axle 14. In this manner, in FIG. 1, the connection location 34 of the upper connection rod is offset relative to the center transverse axis of the axle 14 by a distance D towards the chassis 16. Symmetrically, the connection location 36 of the lower connection rod 28 is offset relative to the center axis of the axle 14 by a same distance d in the longitudinal direction, away from the chassis 16. With this arrangement, there is an equal distribution of the load between the two connection rods 26 and 28 when the resilient member 38 is centered between the connection locations 30 and 32, that is to say, when the center of the member 38 is positioned at an equal distance from the points 30 and 32 on the straight line which extends via the two points 30 and 32.

In the idle state, the connection rods 26 and 28 extend substantially horizontally, that is to say, substantially parallel with the travel plane of the bogie and are entirely located at a vertical level lower than the apex 40 of the casing of the axle box. The apex 40 of the casing of the axle box is the point of this casing located at the highest point relative to the travel plane of the bogie.

The resilient member 38 is a rubber/metal sandwich of the type described in the patent application FR-1 536 401. The resilient member 38 comprises a plurality of mutually parallel rubber layers 42, a plurality of metal plates 44 which are interposed between the rubber layers 42, and metal end plates 46 which are arranged at the base and at the peak of the sandwich. The plates 44 and 46 are mutually parallel and are parallel with the rubber layers 42. Each rubber layer 42 is thus arranged between two metal plates 44 and/or 46 and is adhesively-bonded to these plates.

The compression axis of such a resilient member is perpendicular relative to the plates 44 and 46 and the rubber layers 42.

Such a sandwich has a defined stiffness both in terms of compression and shearing, that is to say, in response to a force which is applied in a direction perpendicular relative to the plane of the plates 44, 46 and layers 42, and parallel with the plane of these plates and these layers, respectively.

The upper and lower connection rods 26 and 28 each comprise a respective lateral extension 48 and 50, which define facing abutment surfaces 52 and 54, respectively, for the resilient member 38. The resilient member 38 is engaged between the surfaces 52 and 54. These surfaces 52 and 54 are mutually parallel, the end plates 46 being pressed on the abutment surfaces and rigidly fixed thereto.

The abutment surfaces 52 and 54 are orientated in such a manner that the compression axis of the resilient member 38 forms in a reference position an angle β of between 0° and 90° relative to the axis which extends via the first connection locations 30 and 32 of the two connection rods. Preferably, the angle β is between, for example, 20° and 60° and is typically 30°.

The two connection rods 26 and 28 are connected to the axle box 18 of the bogie with their respective second connection locations 34 and 36 via cylindrical resilient articulations. The two connection rods are connected to the chassis 16 of the bogie at their first connection locations 30 and 32, respectively, also via cylindrical resilient articulations.

Figure 3:
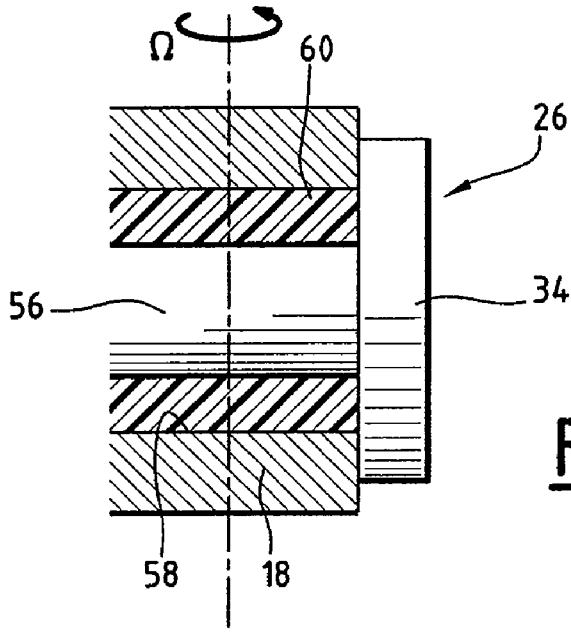
FIG. 3 is a section of the resilient articulation of one of the connection rods, taken along the line of incidence of the arrows III-III of FIG. 1.

The connection rods 26 and 28 comprise, at each of the connection locations 30, 32, 34 and 36, a transverse shaft end 56 which is engaged in a cylindrical hole 58 which is provided, depending on the circumstances, either in the axle box or in the chassis 16 of the bogie (see FIG. 3). A cylindrical resilient sleeve 60, for example, of synthetic or natural rubber, is interposed between the shaft end 56 and the peripheral wall of the hole 58. The shaft end 56, the hole 58 and the sleeve 60 are coaxial, and have a transverse axis. The sleeve 60 is adhesively-bonded via an inner face to the shaft end 56 and via an outer face to the peripheral wall of the hole 58.

The operation of the suspension described above will now be set out in detail below.

Under the effect of a load or a lack of track which causes the wheel 12 to lift, the connection rods 26 and 28 drive the axle box 32 in a vertical movement. The assembly comprised of the chassis 16, the two connection rods 26 and 28 and the axle box 18, which are connected by the connection locations 30, 32, 34, 36 and 38, constitutes a deformable parallelogram.

When the wheel 12 is subject to an upward vertical force F, in the event of a lack of track, for example, the connection rods 26 and 28 each absorb a fraction of the force F at their second respective connection locations 34 and 36, owing to the fact that these first connection locations are placed at one side and the other of the axle. The distribution of the force between the two connection rods 26 and 28 is dependent on the position of the block between the points 30 and 32.

Under the effect of this force, the connection rods 26 and 28 pivot upwards relative to the chassis 16 about first connection locations 30 and 32, that is to say, in the clockwise direction in FIG. 2. Under the effect of these pivoting actions, the abutment surfaces 52 and 54 tend to move towards each other. In the embodiment of FIG. 1, for which the angle β is approximately 30°, the pivoting of the connection rods 26 and 28 leads to both a compression force and a shearing force being applied to the resilient member 38. For an angle β of 90°, the resilient member operates with pure compression. For an angle β of 0°, the resilient member operates with pure shearing.

In parallel, the connection rods 26 and 28 pivot relative to the axle box 18 about the second connection locations 34 and 36 which move vertically upwards, as illustrated in FIG. 1 with broken lines. Of course, the axle box 18 and the apex 40 thereof are also subject to a vertical upward movement. The connection rods 26 and 28 pivot in the clockwise direction in FIG. 1 relative to the axle box 18 and remain at a level lower than the apex 40 of the axle box, which is moved upwards.

The pivoting of the connection rods 26 and 28 brings about torsion, for each connection rod, of the resilient sleeves 60 of the first connection location and the second connection location.

The vertical stiffness Kz of the primary suspension relative to the wheel is therefore the result of three components: the stiffness of the resilient member 38, the torsion stiffness of the cylindrical resilient articulations at the connection locations 30, 32, 34 and 36 and finally the radial stiffness of the cylindrical resilient articulations at the connection locations 30, 32, 34 and 36. The vertical stiffness Kz relative to the wheel may be expressed in the following manner:

$$Kz=1/(1/Kzr+1/Kzp)+Kzt$$

with $$Kzr=2\cdot(\tfrac{1}{2}\cdot KAr)$$

$$Kzp=4\cdot((\sin\beta)^2\cdot KPc+(\cos\beta)^2\cdot KPs)(1/L)^2$$

$$Kzt=4\cdot(KAt/L^2)$$

Kzr being the contribution of the radial stiffness of the cylindrical resilient articulations to the stiffness of the primary suspension relative to the wheel, Kzp being the contribution of the resilient member 38 to the stiffness of the primary suspension relative to the wheel, Kzt being the contribution of the torsion of the cylindrical resilient articulations to the stiffness of the primary suspension relative to the wheel, KAr being the radial stiffness of the cylindrical resilient articulations, KPc being the compression stiffness of the resilient member 38, KPs being the shearing stiffness of the resilient member 38, L being the length of the connection rods between the first connection location and the second connection location, 2l being the distance which separates the first respective connection locations of the two connection rods, and KAt being the torsion stiffness of the cylindrical resilient articulations 38.

If the wheel 12 is subject to a transverse force Fy (see arrow Fy in FIG. 2), each of the connection rods 26 and 28 tends to pivot about an axis which is substantially vertical relative to the axle casing 14 in the region of the second articulation point thereof, and also relative to the chassis 16 in the region of the first articulation point thereof. In this manner, at each connection location, the shaft end 56 of the connection rod tends to become misaligned relative to the cylindrical housing 58, and pivots about a vertical axis (see arrow Ω of FIG. 3).

The transverse stiffness of the primary suspension relative to the wheel may be expressed in the following manner:

$$Ky=1/(1/Kya+1/Kyc),$$

with $$Kya=2\cdot(\tfrac{1}{2}\cdot KAa),$$

$$Kyc=4\cdot(KAc/L^2),$$

Kya being the contribution of the axial stiffness of the cylindrical resilient articulations to the transverse stiffness of the primary suspension, Kyc being the contribution of the conical stiffness of the cylindrical resilient articulations to the transverse stiffness of the primary suspension, KAa being the axial stiffness of a cylindrical resilient articulation, and KAc being the conical stiffness of a cylindrical resilient articulation.

The longitudinal stiffness of the primary suspension relative to the wheel may be expressed in the following manner:

$$Kx=2\cdot(\tfrac{1}{2}\cdot KAr).$$

The rolling stiffness of the axle is expressed in the following manner:

$$Ktetax=Ktetac+Ktetad$$

with $$Ktetac=2\cdot KAc, \text{ and}$$

$$Ktetad=2\cdot Kz\cdot(d/2)^2$$

Ktetac being the contribution of the conical stiffness of the cylindrical resilient articulations to the rolling stiffness of the axle, Ktetad being the contribution of the transverse center distance of the axes to the rolling stiffness of the axle, and d being the center distance between the primary suspensions associated with the two wheels of the same axle along a direction parallel with the axle.

A rolling movement of the axle corresponds to a rotation movement of this axle about an axis substantially parallel with the movement direction of the bogie. In this instance, each connection rod 26 and 28 tends to pivot about an axis parallel with the movement direction of the bogie (indicated with a dot-dash line R in FIG. 2) relative to the axle box 18 in the region of the second connection location, and relative to the chassis 16 in the region of the second connection location. In this manner, at each of the connection locations, the shaft end 56 tends to become misaligned relative to the cylindrical hole 58 and pivots about the axis R.

An embodiment of a primary suspension device as described above will now be set out, suitable for a bogie which has a load of, for example, approximately five tons per wheel.

The connection rods 26 and 28 each have a length L of approximately 400 mm between their respective first and second connection locations. The lever arm 1 is approximately 170 mm, the angle β is approximately 60°. The center distance d between the primary suspensions of the same axle is approximately 1.09 m. The resilient member has a compression stiffness KPc of $3\times10^6$N/m and shearing stiffness KPs of $0.15\times10^6$N/m.

The cylindrical resilient articulations each have a radial stiffness KAr of approximately $175\times10^6$N/m, axial stiffness KAa of approximately $65\times10^6$N/m, and torsion stiffness KAt of 4300 m·N/rd, and conical stiffness KAc of approximately $0.3\times10^6$ m·N/rd.

The primary suspension has, in this instance, a vertical stiffness relative to the wheel Kz of approximately $174\times10^4$N/m, a stiffness parallel with the axle relative to the wheel Ky of substantially $670\times10^4$N/m and a stiffness relative to the wheel in the movement direction of the bogie Kx of substantially $175\times10^6$. The rolling stiffness of the axle is approximately $1.93\times10^6$ m·N/rd.

In the idle state, the primary suspension device has a height which is substantially 300 mm.

The suspension device described above has a number of advantages.

One advantage occurs when the two connection rods are longitudinally offset relative to each other when the suspension device is in the rest state which allows the spacing to be increased between the first respective connection locations of the two connection rods, without increasing the height of the suspension device. This in turn allows resilient members with a larger degree of flexibility to be accommodated, without increasing the height of the suspension device.

Selecting a rubber/metal sandwich as a resilient member also contributes to allowing the suspension to absorb a greater vertical load for a specific vertical suspension space.

Resilient members of the rubber/metal sandwich type may be more compact than the helical springs which are conventionally used.

Furthermore, rubber/metal sandwiches may operate with compression and with shearing, while a helical spring can only operate with compression. It is thus possible to arrange the resilient member of the rubber/metal sandwich type with an angle β which is significantly different from 90°, which contributes to reducing the height of the suspension.

Furthermore, for the same spatial requirement, and in particular in an arrangement in which the rubber/metal sandwich operates principally with compression, the suspension device may absorb more load vertically than with a resilient member which includes a helical spring.

The use of a rubber/metal sandwich allows the angle β to be selected freely and thus allows variable vertical stiffnesses of the suspension to be obtained for the same connection rod positioning.

Furthermore, the greater the longitudinal spacing between the two connection rods, the closer the compression axis of the resilient member is to the vertical (for a fixed angle β), and therefore the greater the possibility of increasing the cross-section of the member perpendicularly relative to the compression axis thereof, and therefore the volume thereof, without increasing the height of the suspension. Alternatively, it is possible to thereby reduce the height of the suspension, without reducing the volume of the resilient member.

In this manner, the use of two offset connection rods and a rubber/metal sandwich allows each primary suspension device to be arranged so that it is located entirely below the apex of the axle box or the axle, if necessary. Each device may have, for example, a height of between 200 mm and 400 mm, preferably between 250 mm and 350 mm and typically 300 mm.

A preferred position of the connection rods involves their being longitudinally offset in a symmetrical manner at one side and the other of the axle, which allows the connection rods to be evenly loaded in the event of vertical stresses on the wheels when the resilient member is located half-way between the first connection locations of the connection rods, as explained above.

The use of cylindrical resilient articulations to connect the connection rods to the chassis on the one hand and to the axle box on the other hand may also be particularly advantageous. These articulations are arranged with axes parallel with the axle, which allows the increase of the stiffness parallel with the axle of the primary suspension, under the action of the conical stiffnesses of the cylindrical resilient articulations, the vertical stiffness of the primary suspension under the action of the torsion stiffnesses of the cylindrical resilient articulations, and the anti-rolling stiffness of the axle also under the action of the conical stiffnesses of the cylindrical resilient articulations.

This final point is particularly significant when the primary suspensions are placed between the wheels of the same axle, in which case the inherent rolling stiffness linked to the transverse center distance between axles is low, taking into account the reduced distance which separates the right-hand and left-hand suspensions of the axle.

Furthermore, the use of cylindrical resilient articulations and a rubber/metal sandwich confers on the primary suspension a sufficient level of damping to allow vertical shock-absorbers to be dispensed with in the primary suspension.

Furthermore, the height adjustment of the suspension can be carried out by arranging wedges between the rubber/metal sandwich and the abutment surfaces of the connection rods.

The suspension device described above may have a number of variants.

The lower and upper connection rods may not be perpendicular relative to the axle but instead may extend parallel with the axle.

In another construction variant, the resilient member 38 may not be a rubber/metal sandwich but instead a helical spring or any other type of resilient member.

Also in a further variant of the invention, the connection rods may be connected to the first and second elements not by means of cylindrical resilient articulations but instead by any other type of articulation, for example, by means of spherical joints.

Also in an additional manner, it is possible to arrange the connection rods 26 and 28 in such a manner that the second connection locations of these rods are not symmetrical relative to the axle 14.

Owing to the spatial requirement and architecture of the bogie, the resilient member may be offset with respect to the connection rods, in an upward or downward direction, to the left or to the right relative to the position illustrated in FIG. 1.

In the case of bogies which comprise fixed axles on which the wheels are rotatably mounted, the connection rods 26 and 28 can be connected via their second respective connection locations 34 and 36 directly to the axles. The connection rods may also be connected, via their first connection location to other fixed components of the bogie, for example, to braking members.

In the case of bogies which are provided with the axles comprising a rotating shaft which connects the wheels in terms of rotation, and a housing which provides the mechanical stiffness of the axle and the rotational guiding of the rotating shaft, the connection rods 26 and 28 can be connected to the housing via their second connection locations 34 and 36, respectively. The housing, in this instance, extends practically over the entire length of the axle, from one wheel to the other.

The device may comprise a plurality of resilient members 38 which are interposed in parallel between the two connection rods.

The primary suspension devices may not be arranged towards the inner side of the bogie relative to the wheels, but instead immediately at the outer side of the bogie relative to the wheels.

The suspension device may be integrated in a secondary suspension of the bogie, the second element in this instance being the chassis of the bogie, the first element being the body of the rail vehicle in the case of a non-pivoting bogie, and being the bogie bolster in the case of a bogie which pivots relative to the body.

The suspension devices described above may be used on bogies for any type of rail vehicle, for example, tramways, or any type of train.

What is claimed is:

1. A device for suspending a first element on a second element of a rail vehicle, the device comprising:

two longitudinal connection rods, each connected to the first element at a first connection location, and connected to the second element at a second connection location, the two connection rods being longitudinally offset relative to each other; and at least one resilient member interposed between the two connection rods defining at least a vertical stiffness of the suspension device, the at least one resilient member being a sandwich including a plurality of layers of a resilient material and a plurality of metal plates interposed between the layers of resilient material and adhesively-bonded to the resilient layers, the at least one resilient member having a compression axis forming an angle with respect to an axis that extends through the first connection locations of the two connection rods such that forces acting upon the resilient member when the second element is subject to a vertical force are both a compression force and a shearing force.

2. The device according to claim 1 wherein the two connection rods are parallel with each other and have, between the first and second respective connection locations, the same length longitudinally.

3. The device according to claim 1 wherein the two connection rods are positioned in a same vertical plane.

4. The device according to claim 1 wherein the at least one resilient member has a compression axis which forms an angle between 20° and 60° with respect to an axis that extends through the first connection locations of the two connection rods.

5. The device according to claim 1 wherein the resilient member is engaged between two abutment surfaces of the connection rods.

6. A rail vehicle bogie comprising:

at least one suspension device including:

two longitudinal connection rods, each rod connected to a first element at first connection location and each rod connected to a second element at a second connection location, the two connection rods being longitudinally offset relative to each other; and at least one resilient member interposed between the two connection rods defining at least a vertical stiffness of the suspension device, the at least one resilient member being a sandwich including a plurality of layers of a resilient material and a plurality of metal plates interposed between the layers of resilient material and adhesively-bonded to the resilient layers, the at least one resilient member having a compression axis forming an angle between 20° and 60° with respect to an axis that extends through the first connection locations of the two connection rods.

7. The rail vehicle bogie according to claim 6 wherein the first element is a chassis of the bogie of the rail vehicle and the second element is an axle or an axle box of the bogie.

8. The rail vehicle bogie according to claim 7 wherein each of the two connection rods is connected to the axle or the axle box of the bogie at the second connection location thereof by a cylindrical resilient articulation and to the chassis of the bogie at the first connection location thereof by another cylindrical resilient articulation.

9. The rail vehicle bogie according to claim 8 wherein the connection rods extend perpendicularly relative to the axle and the cylindrical resilient articulations have axes parallel with the axle.

10. The rail vehicle bogie according to claim 9 wherein the second connection locations of the two connection rods are longitudinally offset in a symmetrical manner on either side of the axle.

11. The rail vehicle bogie according to claim 7 wherein the two connection rods are arranged at a vertical level lower than an apex of the axle or the axle box.

12. A rail vehicle comprising:

at least one suspension device including:

two longitudinal connection rods, each connected to a first element at a first connection location and connected to a second element at a second connection location, the two connection rods being longitudinally offset relative to each other; and at least one resilient member interposed between the two connection rods defining at least a vertical stiffness of the suspension device, the at least one resilient member being a sandwich including a plurality of layers of a resilient material and a plurality of metal plates interposed between the layers of resilient material and adhesively-bonded to the resilient layers, the at least one resilient member having a compression axis forming an angle between 20° and 60° with respect to an axis that extends through the first connection locations of the two connection rods.

13. The rail vehicle according to claim 12 wherein the first element is a rail vehicle body and the second element is a chassis of a bogie of the rail vehicle positioned below the body.

* * * * *